US009132329B2

(12) United States Patent
Ebert

(10) Patent No.: US 9,132,329 B2
(45) Date of Patent: Sep. 15, 2015

(54) BASEBALL THROWING AID

(71) Applicant: Dylan Ebert, O'Fallon, MO (US)

(72) Inventor: Dylan Ebert, O'Fallon, MO (US)

( * ) Notice: Subject to any disclaimer, the term of this patent is extended or adjusted under 35 U.S.C. 154(b) by 136 days.

(21) Appl. No.: 14/028,853

(22) Filed: Sep. 17, 2013

(65) Prior Publication Data

US 2014/0106907 A1 Apr. 17, 2014

Related U.S. Application Data

(60) Provisional application No. 61/714,321, filed on Oct. 16, 2012.

(51) Int. Cl.
*A63B 69/00* (2006.01)
*A63B 43/00* (2006.01)
*A63B 71/06* (2006.01)

(52) U.S. Cl.
CPC ..... *A63B 69/0002* (2013.01); *A63B 43/002* (2013.01); *A63B 43/008* (2013.01); *A63B 2069/0006* (2013.01); *A63B 2071/0694* (2013.01)

(58) Field of Classification Search
CPC ..... A63B 69/0002; A63B 2069/0006; A63B 43/00; A63B 43/08; A63B 43/002; A63B 43/02; A63B 37/14
USPC ..... 473/451, 458, 424, 596, 614; D21/713
See application file for complete search history.

(56) References Cited

U.S. PATENT DOCUMENTS 2,309,475 A * 1/1943 Palmieri ..... 446/240
3,110,494 A * 11/1963 Morgan ..... 473/458
3,152,803 A * 10/1964 Sain, Jr. ..... 473/424
3,563,548 A * 2/1971 Tolotti ..... 473/588
4,286,783 A * 9/1981 Newcomb et al. ..... 473/451
4,610,447 A * 9/1986 Byrd ..... 482/74
5,407,193 A * 4/1995 McGinley ..... 473/451
5,588,648 A * 12/1996 Stebbins ..... 473/451
5,607,152 A * 3/1997 Strassburger ..... 473/451
5,830,091 A * 11/1998 Romanick ..... 473/596
6,024,660 A * 2/2000 Romanick ..... 473/596
6,190,292 B1 * 2/2001 Panes ..... 482/93
6,471,606 B1 * 10/2002 Simpson ..... 473/451
6,663,519 B2 * 12/2003 Kuhn et al. ..... 473/597
D519,588 S * 4/2006 Carbonero ..... D21/707
7,048,656 B2 * 5/2006 Litchfield ..... 473/598
7,285,080 B1 * 10/2007 Chiu ..... 482/142
7,458,945 B2 * 12/2008 Zemont ..... 601/131
D619,663 S * 7/2010 Quinn ..... D21/713
8,608,600 B2 * 12/2013 Naum ..... 473/614
8,708,843 B1 * 4/2014 Sekac et al. ..... 473/451
D725,206 S * 3/2015 Johnston ..... D21/713
2006/0223656 A1 * 10/2006 Libonati ..... 473/422
2009/0011870 A1 * 1/2009 Neal et al. ..... 473/451
2009/0137350 A1 * 5/2009 Lenig ..... 473/451
2010/0048331 A1 * 2/2010 Guilfoyle ..... 473/451

(Continued)

*Primary Examiner* — Mark Graham

(74) *Attorney, Agent, or Firm* — Polster, Lieder, Woodruff & Lucchesi, L.C.

(57) ABSTRACT

A baseball or softball (B) throwing aid (10) for teachings players, particularly young players the proper mechanics for throwing a ball. The aid includes a rod or bar (12) projecting from each side of the ball. One half of each rod or bar is one color (G) and the other half a different color (R). The throwing practice aid teaches the player to get their thumb in the correct position before they throw the ball. If a thrower doesn't have their thumb facing the correct way before throwing the ball, they are pulling and pushing the ball instead of throwing it.

9 Claims, 1 Drawing Sheet

(56) References Cited

U.S. PATENT DOCUMENTS

2013/0040766 A1* 2/2013 Massey ..... 473/451
2014/0135151 A1* 5/2014 Johnston ..... 473/451
2014/0228157 A1* 8/2014 Johnston ..... 473/451

* cited by examiner

BASEBALL THROWING AID

CROSS REFERENCE TO RELATED APPLICATIONS

This application is based upon, and claims the benefit of U.S. provisional patent application 61/714,321 filed Oct. 16, 2012, which is hereby incorporated by reference.

STATEMENT REGARDING FEDERALLY SPONSORED RESEARCH OR DEVELOPMENT

N/A

BACKGROUND OF THE INVENTION

Currently there are over two million boys ranging in age from 4 to 18 playing some form of youth baseball in this country. Another 1.3 million girls are currently playing some type of youth softball. Unfortunately, a significant number of these boys and girls do not know how to throw a baseball or softball properly. Not employing the correct mechanics in throwing a ball can, over time, create bad throwing habits which will affect a player's quality of play, as well as potentially cause physical injuries to their elbow, arm, and wrist.

The correct mechanics for throwing a ball are that when one draws back their arm, in preparing to throw the ball, the palm of their throwing hand should face behind them as should their thumb. This hand/thumb position is sometimes referred to as "pointing to the outfield".

The present invention is directed to a teaching aid useful for teaching people of all ages and skill levels, but especially younger persons, how to throw a ball correctly. The teaching aid is made for anyone participating in (playing) baseball or softball. It has been developed to help boys and girls, young men and women, teenagers, and high school baseball or softball players develop and maintain the proper mechanics in throwing a ball. The invention provides a useful tool for parents and coaches (particularly pitching coaches), and anybody else wanting to teach or learn how to throw a ball correctly.

BRIEF SUMMARY OF THE INVENTION

The present invention comprises a rod or bar extending from opposite sides of a baseball or softball. Opposite sides of the rod or bar are differently coded so that someone using the aid in learning how to throw a ball can immediately tell if they are doing it correctly. The coding can be a color coding (e.g., green on one side, red on the other), or some type of symbol or word(s) (e.g., "correct", "wrong") which makes it readily apparent to the user if they are correctly preparing to throw.

The bar or rod is integrally formed with the ball; that is, the ball and bar or rod are made as a molded plastic piece. Alternatively, the rod or bar is inserted in a hole or opening drilled through a baseball or softball. Or, there can be two separate rods or bars which are attached to opposite sides of a ball. Also, the two rods or bars are integrally formed with a yoke sized to snuggly fit about the cover of a ball with the yoke being fitted about the ball for practice and then removed for play with the ball.

Among the advantages of the baseball throwing aid of the present invention are that it teaches the proper way to position one's thumb on the ball before throwing the ball and how to properly prepare to throw the ball in an easy to visualize and understand way.

The baseball throwing aid can be used by anybody wanting to learn how to properly throw a baseball or softball. Importantly, the baseball throwing aid helps prevent arm injuries, particularly among younger players by instilling in them at an early age the proper throwing mechanics.

The baseball throwing aid is simple, relatively low cost, and easy to use. It can be carried in a sports equipment bag or a player's gym bag or the like, and can be used during practice before games, or for practicing at home in front of a mirror, or outside in the yard while playing "pitch and catch" with a family member or friend.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

Figure 1A:
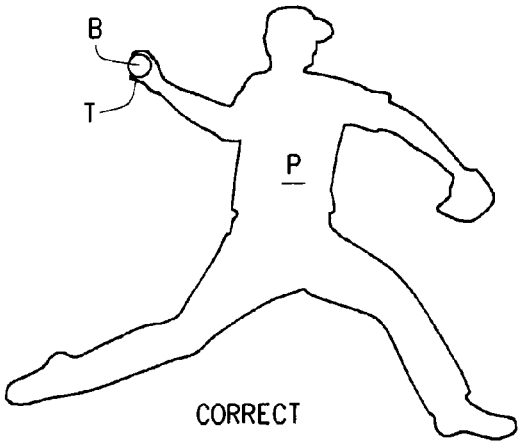
FIGS. 1A and 1B are simplified representations of how to correctly prepare to throw a ball (FIG. 1A) and incorrectly do so (FIG. 1B)

Throughout the drawings, the reference character B refers to a ball. The ball can be either a baseball or a softball without departing from the scope of the invention. A baseball is typically smaller in diameter than a softball and may have a cover made of a different material. Baseballs are usually thrown overhand by a pitcher to a batter, and softballs underhanded. Other players usually throw either ball overhand to each other.

Figure 1B:
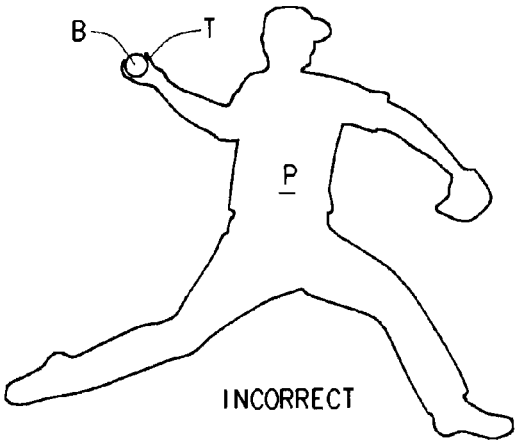
Figure 2A:
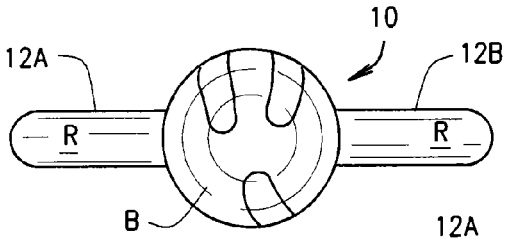
FIG. 2A is an elevation view of one embodiment of the baseball throwing aid and FIG. 2B is a plan view thereof; and, FIGS. 3A-3C are respective representations of other embodiments of the throwing aid.
Figure 2B:
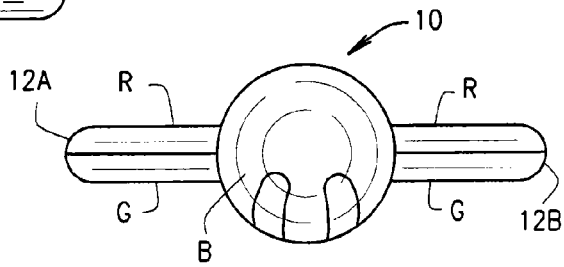

The present invention is directed to a training aid indicated general 10 in FIGS. 2A and 2B to aid in teaching the proper mechanics of throwing a baseball or softball B from one player to another. Training aid 10 teaches a player the correct position of the thumb on his or her throwing hand after the player has drawn back their arm to throw the ball, but before the arm moves forward in the throwing motion. This is as shown in FIG. 1A in which player P has his or her arm drawn back preparing to throw the ball. In the correct throwing position shown in FIG. 1A, the player's thumb points behind them. In the incorrect position shown in FIG. 1B, the ball is cupped in the player's hand and their thumb points skyward rather than behind them. Pitching aid 10 is designed to provide a visual indication that tells the thrower that their thumb is pointed in the correct direction.

In the embodiment of pitching aid 10 shown in FIGS. 2A and 2B, a projection such as a rod or bar 12A, 12B extends outwardly from a ball B on opposite sides of the ball. That is, one projection extends from the side of the ball and a second projection extends from the side of the ball oppositely of the first projection. Each rod is, for example, 4"-6" long and ¾"-1" in diameter. As shown in FIG. 2B, the opposite sides of each rod are of a different color. For example, the side of the bars the player would see when he or she has drawn the ball back correctly would be green as indicated G; while, if the ball is drawn back incorrectly the color they would see would be red as indicated R. Such a visual indication makes it readily apparent to the player if they are doing it right or wrong. Importantly, pitching aid 10 is not to be thrown. Rather, it's intended only to provide a visual indication to the player of his or her use of the proper mechanics prior to throwing a ball.

Pitching aid 10 is, in one embodiment, of a molded plastic two-piece construction. That is, the aid is molded in two sections which are then glued, sonic welded or otherwise joined together. One section comprises one-half of the ball and rods or bars 12A, 12B and is molded in one color, and the other section comprises the other half of the ball and rods or bars and is molded in a different, contrasting color. As in the above example, the one side of the pitching aid is "green" to indicate the proper placement of the hand and thumb in the drawn-back position before throwing the ball; and the other side is "red" to indicate the wrong drawn-back hand/thumb position before throwing the ball.

Also shown in FIGS. 2A and 2B are outlines for positioning a player's fingers and thumbs on the ball so to assist the player in gripping it properly. If the ball of the pitching aid is molded, these positions would comprise indentations formed on the outside of the ball.

In another embodiment of the pitching aid 10, ball B and the rods or bars 12A, 12B are of a rubber material. The pitching aid has the rods or bars projecting from opposite sides of the ball. In this embodiment, the ball is white, for example, with the opposite sides of each rod or bar red and green as before.

Figure 3A:
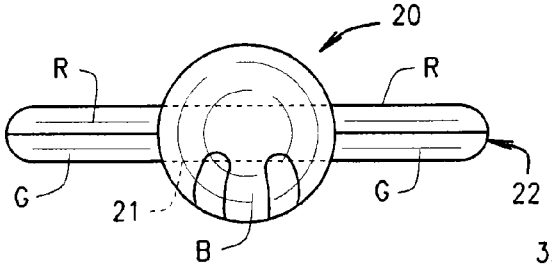

Referring to FIG. 3A, in another embodiment of the pitching aid, indicated 20, ball B has a central bore 21 through which a rod or bar 22 is inserted so that the ends of the bar or rod project from opposite sides of the ball. As before, one side of the bar or rod is green and the opposite side red.

Figure 3B:
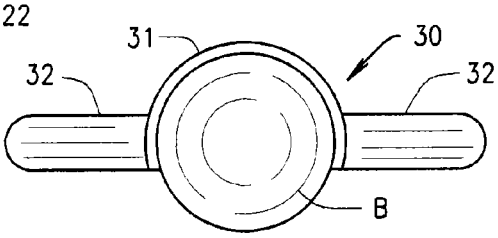

Referring to FIG. 3B, in another embodiment of the pitching aid, indicated 30, ball B is a regulation baseball or softball used in games. A yoke 31 has a curvature corresponding to that of the ball. From each end of the yoke, a rod or bar 32 extends. Again, one side of the bar or rod is green and the opposite side red. The yoke and side bars or rods are of a one-piece construction and the yoke is designed to fit snuggly about the cover of ball B. In this embodiment, one practices with a regulation ball by fitting the yoke over the cover of the ball and practicing as previously described. To use the ball for actual play, the yoke is simply removed and set aside.

Figure 3C:
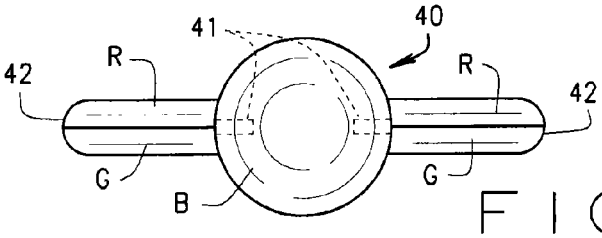

Referring to FIG. 3C, in another embodiment of the pitching aid, indicated 40, ball B is again a regulation baseball or softball used in games. If ball B is a well-used ball such that it no longer is used for actual play, holes 41 are drilled into opposite sides of the ball and rods or bars 42 have a threaded end which is screwed into place. As before, one side of the bar or rod is green and the opposite side red. Those skilled in the art will understand that other means of attachment can also be used to attach the rods or bars to the side of the ball.

Each embodiment of the throwing aid includes indicia either formed on the ball or applied to the surface of the ball, using decals or the like, which indicate where the fingers and thumb should be placed for holding the aid. This is as shown in FIG. 4. Use of the throwing aid on a regular basis helps develop the player's correct throwing mechanics. Importantly, the training aid also provides coaches and parents a simple, easy-to-use visual aid to better show a player where to place their fingers and thumb.

In use, one learns the correct throwing technique while preventing arm injuries, particularly among younger players.

Finally, the throwing aid is relatively low cost. It is easily stored when not in use and can be carried in an equipment bag or player's gym bag for ready accessibility to practice before games, or for practicing at home in front of a mirror, or outside in the yard.

In view of the above, it will be seen that the several objects and advantages of the present disclosure have been achieved and other advantageous results have been obtained.

The invention claimed is:

1. A training aid for teaching the proper mechanics of throwing a baseball or softball from one player to another, the training aid teaching a player the correct position of the thumb on their throwing hand after the player has drawn back their arm to throw the ball, but before the arm moves forward in the throwing motion, comprising:

a ball whose size and shape corresponds to that of a baseball or softball; and, a first projection extending from the side of the ball and a second projection extending from the side of the ball oppositely of the first projection, the projections comprising one of a rod or a bar and with each projection having indicia thereon indicating to the player, when the player has drawn the ball back into a throwing position, whether or not they are gripping the ball properly; and, corresponding halves of the rods or bars being of one color and the other corresponding halves being of a different color whereby if the portions of the rods or bars seen by the player when they have drawn the ball back correctly would be one color; while, if the ball is drawn back incorrectly the color they would see would be the other color.

2. The training aid of claim 1 which is of a molded plastic two-piece construction.

3. The training aid of claim 2 in which is molded in two sections which are then joined together, one section comprising one half of the ball and projections being molded in one color, and the other section comprising the other half of the ball and projections being molded in a different, contrasting color.

4. The training aid of claim 1 in which the first and second projections are formed of a single piece which extends longitudinally through a bore formed in the ball and out the sides of the ball.

5. The training aid of claim 1 further including a yoke having a curvature corresponding to that of the ball with one of the projections extending outwardly from each end of the yoke, the yoke fitting snuggly about a cover of the ball whereby a player can practice with a regulation ball by fitting the yoke over the cover of the ball, with the yoke then being removed for use of the ball in actual play.

6. The training aid of claim 5 in which the yoke and projections are of a one-piece construction.

7. The training aid of claim 1 further including outlines on the ball for positioning a player's fingers and thumbs on the ball so to assist the player in gripping the ball properly.

8. The training aid of claim 7 in which, if the ball of the pitching aid is of a molded construction, the finger and thumb positions are comprised of indentations formed on the outside of the ball.

9. A training aid for teaching the proper mechanics of throwing a baseball or softball from one player to another, the training aid teaching a player the correct position of the thumb on their throwing hand after the player has drawn back their arm to throw the ball, but before the arm moves forward in the throwing motion, comprising:

a ball whose size and shape corresponds to that of a baseball or softball; and, a first projection extending from the side of the ball and a second projection extending from the side of the ball oppositely of the first projection, the projections comprising one of a rod or a bar and with each projection having indicia thereon indicating to the player, when the player has drawn the ball back into a throwing position, whether or not they are gripping the ball properly, and, corresponding halves of the rods or bars have one word or symbol on them and the other corresponding halves have a different word or symbol on them whereby if the portions of the rods or bars seen by the player when they have drawn the ball back correctly would show the one word or symbol; while, if the ball is drawn back incorrectly the word or symbol they would see would be the other word or symbol.

* * * * *